US010031441B2

(12) United States Patent
Yoshida et al.

(10) Patent No.: US 10,031,441 B2
(45) Date of Patent: Jul. 24, 2018

(54) DEVELOPING DEVICE, AND IMAGE FORMING APPARATUS AND PROCESS CARTRIDGE INCORPORATING SAME

(71) Applicant: Sayuri Katoh, Kanagawa (JP)

(72) Inventors: Keiichi Yoshida, Kanagawa (JP); Shinji Tamaki, Tokyo (JP); Ichiro Kadota, Kanagawa (JP); Hiroshi Hosokawa, Kanagawa (JP); Shunji Katoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/288,939

(22) Filed: Oct. 7, 2016

(65) Prior Publication Data

US 2017/0115605 A1 Apr. 27, 2017

(30) Foreign Application Priority Data

Oct. 26, 2015 (JP) ..... 2015-210121
Feb. 19, 2016 (JP) ..... 2016-029830

(51) Int. Cl.
*G03G 15/08* (2006.01)
*G03G 21/18* (2006.01)

(52) U.S. Cl.
CPC ..... *G03G 15/0891* (2013.01); *G03G 21/18* (2013.01)

(58) Field of Classification Search
CPC combination set(s) only.
See application file for complete search history.

(56) References Cited

U.S. PATENT DOCUMENTS

2005/0238384 A1* 10/2005 Sampe ..... G03G 21/007 399/111
2007/0166074 A1 7/2007 Hosokawa et al.
2008/0286013 A1 11/2008 Hosokawa et al.
2009/0136257 A1 5/2009 Hattori et al.
2009/0175660 A1 7/2009 Hosokawa et al.
2010/0014895 A1 1/2010 Hosokawa et al.
2010/0129113 A1 5/2010 Sampe et al.
2010/0202805 A1 8/2010 Miyoshi et al.
2010/0215397 A1 8/2010 Sampe et al.
2011/0008073 A1 1/2011 Kudoh et al.
2011/0026973 A1 2/2011 Hosokawa et al.
2011/0058858 A1* 3/2011 Fukuda ..... G03G 15/0806 399/272

(Continued)

FOREIGN PATENT DOCUMENTS

JP 2008-304846 12/2008
JP 2010-175945 8/2010

(Continued)

*Primary Examiner* — Clayton E Laballe
*Assistant Examiner* — Jas Sanghera
(74) *Attorney, Agent, or Firm* — Duft Bornsen & Fettig LLP

(57) ABSTRACT

A developing device includes a developer bearer to bear developer, a developer containing compartment disposed lower than the developer bearer, and a conveying screw disposed in the developer containing compartment. The developing device further includes an inclined face extending from an inner wall of the developer containing compartment obliquely upward toward the developer bearer, and the inclined face opposes the conveying screw from above.

18 Claims, 10 Drawing Sheets

(56) References Cited

U.S. PATENT DOCUMENTS

| | | | | |
|---|---|---|---|---|
| 2011/0150525 | A1 | 6/2011 | Fujiwara et al. | |
| 2011/0243612 | A1 | 10/2011 | Hosokawa et al. | |
| 2011/0249991 | A1 | 10/2011 | Hosokawa et al. | |
| 2012/0051793 | A1 | 3/2012 | Kudoh et al. | |
| 2012/0230736 | A1 | 9/2012 | Hosokawa et al. | |
| 2013/0216250 | A1 | 8/2013 | Seki et al. | |
| 2014/0016960 | A1 | 1/2014 | Miyoshi et al. | |
| 2014/0314451 | A1 | 10/2014 | Hosokawa et al. | |
| 2015/0086247 | A1* | 3/2015 | Yoshimoto ..... | G03G 15/0921 399/277 |
| 2015/0338778 | A1* | 11/2015 | Matsumoto ..... | G03G 15/0893 399/254 |
| 2016/0026116 | A1 | 1/2016 | Hosokawa et al. | |

FOREIGN PATENT DOCUMENTS

| | | |
|---|---|---|
| JP | 2011-170188 | 9/2011 |
| JP | 2015-215369 | 12/2015 |

* cited by examiner

DEVELOPING DEVICE, AND IMAGE FORMING APPARATUS AND PROCESS CARTRIDGE INCORPORATING SAME

CROSS-REFERENCE TO RELATED APPLICATIONS

This patent application is based on and claims priority pursuant to 35 U.S.C. § 119(a) to Japanese Patent Application Nos. 2015-210121, filed on Oct. 26, 2015, and 2016-029830, filed on Feb. 19, 2016, in the Japan Patent Office, the entire disclosure of each of which is hereby incorporated by reference herein.

BACKGROUND

Technical Field

Embodiments of the present invention generally relate to a developing device, and a process cartridge and an image forming apparatus, such as a copier, a printer, a facsimile machine, or a multifunction peripheral having at least two of copying, printing, facsimile transmission, plotting, and scanning capabilities, that include the developing device.

Description of the Related Art

There are developing devices that include a developer containing compartment to contain two-component developer including magnetic carrier and toner and a developer bearer containing a magnetic field generator. The magnetic field generator exerts a magnetic force to attract the two-component developer onto the surface of the developer bearer, and the developer bearer transports the developer to a developing range facing a latent image bearer.

Such developing devices further include a developer regulator, which adjusts the amount of developer borne on the surface of the developer bearer, and a developer conveyor, which stirs and transports the developer inside the developer containing compartment. For example, the developer containing compartment is positioned lower than the developer bearer. For example, the developer conveyor is a conveying screw including a shaft and a spiral blade winding around the shaft. While being transported by the conveying screw, the developer is attracted by the magnetic force of a developer scooping pole of the magnetic field generator and borne on the surface of the developer bearer.

SUMMARY

In one embodiment, a developing device includes a developer bearer to bear developer, a developer containing compartment disposed lower than the developer bearer, and a conveying screw disposed in the developer containing compartment. The developing device further includes an inclined face extending from an inner wall of the developer containing compartment obliquely upward toward the developer bearer, and the inclined face opposes the conveying screw from above.

In another embodiment, an image forming apparatus includes a latent image bearer to bear a latent image, and the above-described developing device to develop the latent image on the latent image bearer with the developer.

In yet another embodiment, a process cartridge to be removably mounted in an image forming apparatus includes a latent image bearer to bear a latent image, the above-described developing device to develop the latent image, and a frame to support the latent image bearer and the developing device as a unit.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
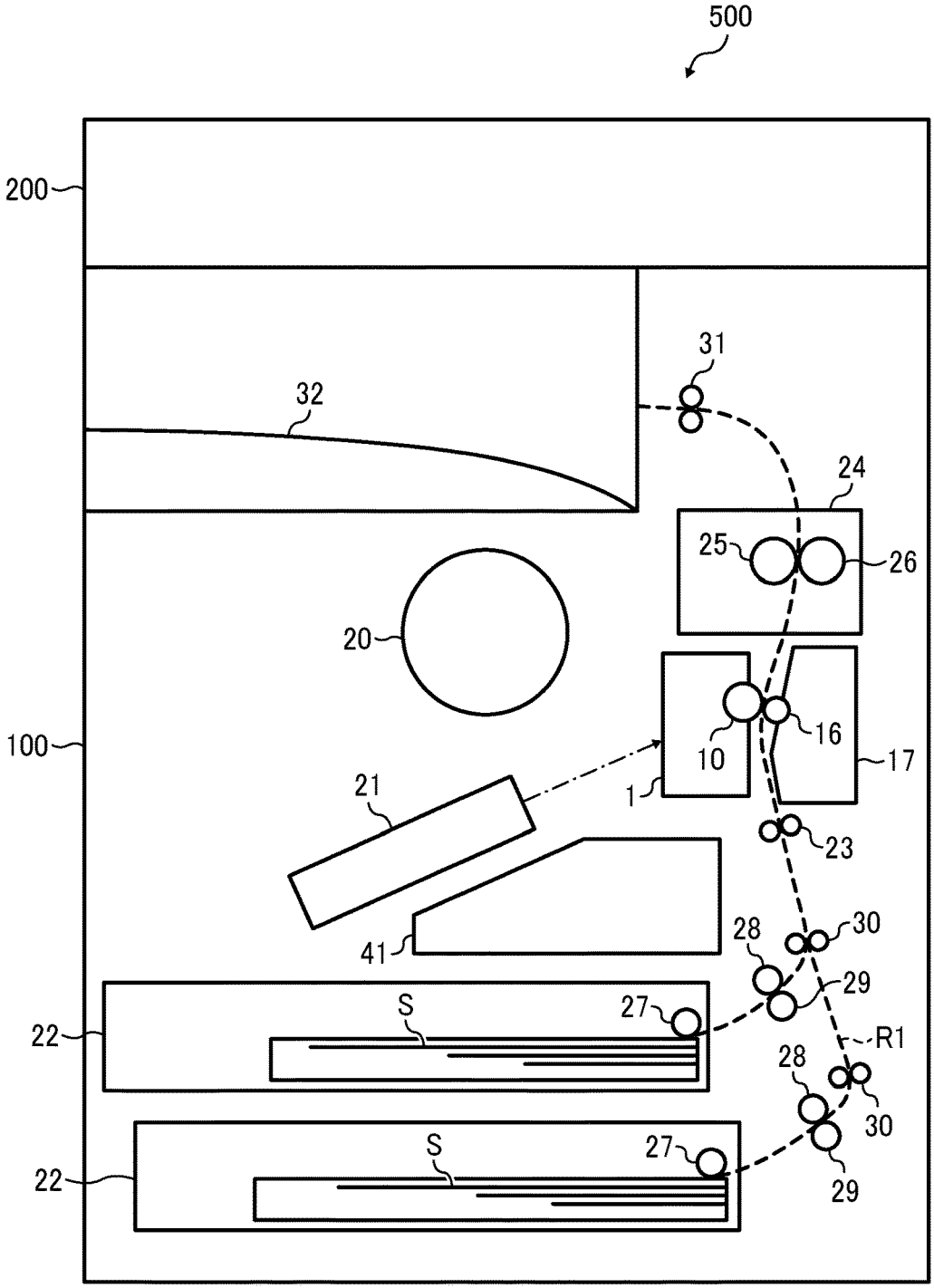
FIG. 1 is a schematic view of an image forming apparatus according to an embodiment.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

FIG. 1 is a schematic view of an image forming apparatus 500 according to an embodiment.

For example, the image forming apparatus 500 is a copier and includes a scanner 200 (i.e., an image reading device) disposed above an apparatus body 100. The apparatus body 100 contains a process cartridge 1.

Figure 2A:
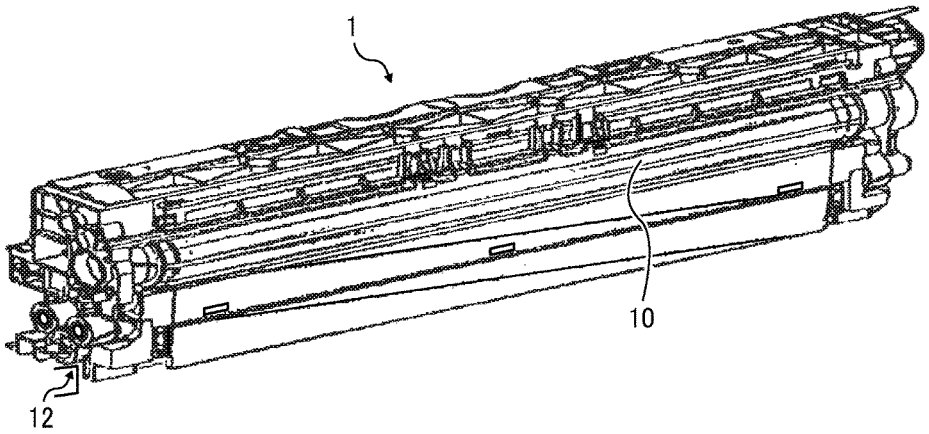
FIG. 2A is a perspective view of a process cartridge of the image forming apparatus illustrated in FIG. 1.
Figure 2B:
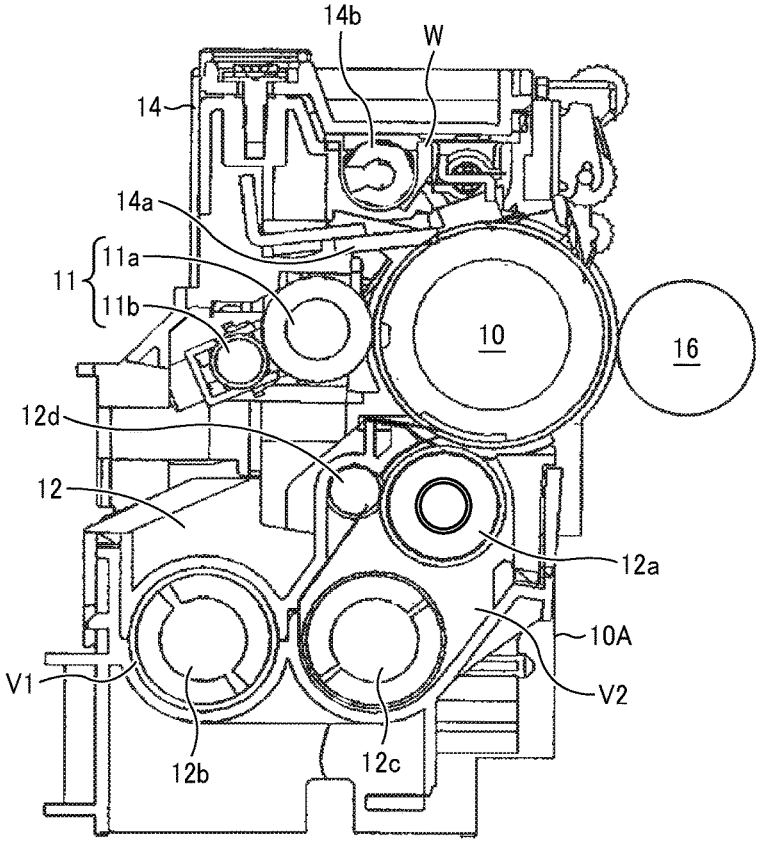
FIG. 2B is a cross-sectional view of the process cartridge.

FIG. 2A is a perspective view of the process cartridge 1, and FIG. 2B is a cross-sectional view of the process cartridge 1.

As illustrated in FIG. 2B, the process cartridge 1 includes a photoconductor 10 serving as a latent image bearer. Around the photoconductor 10, devices to execute image forming processes on the photoconductor 10, namely, a charging device 11, a developing device 12, a cleaning device 14, and the like are disposed. The process cartridge 1 includes a frame 10A to support the components of the process cartridge 1 as a unit. The process cartridge 1 is removably mountable in the apparatus body 100. When the photoconductor 10, the charging device 11, the developing device 12, and the cleaning device 14 are united into the process cartridge 1, replacement work and maintenance work can be easier. Additionally, in the process cartridge 1, the relative positions of the components can be kept at a higher degree of accuracy, thus enhancing the quality of images produced.

The charging device 11 (i.e., a charger) includes a charging roller 11*a* and a removing roller 11*b*. A charging bias is applied to the charging roller 11*a*, and the charging roller 11*a* gives electrical charges to the surface of the photoconductor 10 to uniformly charge the photoconductor 10. The removing roller 11*b* removes substances, such as toner, adhering to the surface of the charging roller 11*a*.

The developing device 12 includes a first developer compartment V1, in which a first conveying screw 12*b* serving as a developer conveyor is disposed. The developing device 12 further includes a second developer compartment V2 (a developer containing compartment), in which a second conveying screw 12*c* serving as another developer conveyor, a developing roller 12*a* serving as a developer bearer, and a developer doctor 12*d* serving as a developer regulator are disposed.

The first and second developer compartments V1 and V2 contain two-component developer including magnetic carrier and negatively charged toner. Being rotated by a driver, the first conveying screw 12*b* transports the developer inside the first developer compartment V1 to the front side of the paper on which FIG. 2A is drawn. At the end of the first developer compartment V1 on the front side, the developer transported by the first conveying screw 12*b* enters the second developer compartment V2.

Being rotated by the driver, the second conveying screw 12*c* inside the second developer compartment V2 transports the developer to the back side of the paper on which FIG. 2A is drawn. Above the second conveying screw 12*c* in FIG. 2B, the developing roller 12*a* (the developer bearer) is disposed in parallel to the second conveying screw 12*c*. The developing roller 12*a* includes a nonmagnetic developing sleeve 12*a*2 (illustrated in FIG. 6) that rotates and a stationary magnet roller 12*a*1 disposed inside the developing sleeve 12*a*2. The magnet roller 12*a*1 serves as a magnetic field generator.

A portion of the developer transported by the second conveying screw 12*c* is scooped onto the surface of the developing roller 12*a* due to the magnetic force exerted by the magnet roller 12*a*1. The developer doctor 12*d* is rod-shaped and disposed across a predetermined gap from the surface of the developing roller 12*a*. The developer doctor 12*d* adjusts the thickness of a layer of developer borne on the developing roller 12*a*. Subsequently, the developer is transported to the developing range opposing the photoconductor 10, and the toner in the developer adheres to an electrostatic latent image on the photoconductor 10. Thus, a toner image is formed on the photoconductor 10. After the toner therein is thus consumed, the developer is returned to the second conveying screw 12*c* as the developing roller 12*a* rotates. The developer transported to the end of the second developer compartment V2 by the second conveying screw 12*c* is returned to the first developer compartment V1. Thus, the developer is circulated inside the developing device 12.

The developing device 12 further includes a toner concentration sensor 124 (illustrated in FIG. 5) serving as a toner concentration detector to detect the content (or percentage) of toner in the developer in the first developer compartment V1. For example, the toner concentration sensor 124 measures the toner concentration based on the magnetic permeability of the developer. As the toner concentration decreases, the magnetic carrier becomes denser, and the magnetic permeability increases. When a value detected by the toner concentration sensor 124 deviates from a target value (threshold), toner is supplied from a toner bottle 20 (illustrated in FIG. 1), serving as a toner container, to the developing device 12 to keep the toner concentration constant or substantially constant. For the target value, a toner pattern is formed on the photoconductor 10, and an optical sensor detects the amount of toner adhering to the toner pattern. The target value is determined based on the detected toner adhesion amount.

Although this operation is performed to keep the density of the toner pattern (i.e., a reference pattern) on the photoconductor 10 constant, decreases in the toner concentration in the developer are inevitable when the toner bottle 20 becomes empty. In such a situation, even if the operation to supply the toner from the toner bottle 20 is executed for a certain length of time, the toner adhesion amount of the toner pattern, detected by the optical sensor, does not recover. Accordingly, in a case where the toner adhesion amount of the toner pattern, detected by the optical sensor, does not recover despite the operation to supply the toner from the toner bottle 20, a controller of the image forming apparatus 500 determines (or estimates) that there is no toner (toner end).

After the toner bottle 20 is replaced in response to the determination of "toner end", the following operation is executed to supply toner from the toner bottle 20 to the developing device 12. The developing roller 12*a* and the first and second conveying screws 12*b* and 12*c* are rotated to mix the supplied toner with the developer. At that time, to prevent uneven vibration given to the developer borne on the developing roller 12*a*, the photoconductor 10 is rotated with the potentials thereof kept to a degree not to attract the toner.

The cleaning device 14 includes a cleaning blade 14*a* that contacts or abuts against the photoconductor 10 to scrape off the toner adhering to the photoconductor 10 after a transfer process. The cleaning device 14 further includes a toner collecting coil 14*b* disposed in a collected toner compartment W to transport the toner collected by the cleaning blade 14*a*. The collected toner is further transported by a toner conveyance device to either the developing device 12 or a waste-toner bottle 41.

A transfer device 17 illustrated in FIG. 1 includes a transfer roller 16 pressed to the surface of the photoconductor 10. Disposed above the transfer device 17 is a thermal fixing device 24, which includes a heating roller 25 and a pressing roller 26. The apparatus body 100 further contains a laser writing device 21 serving as a latent image forming device. The laser writing device 21 includes a laser light source, a polygon mirror for scanning, a polygon motor, an fθ lens, and the like. The apparatus body 100 further contains sheet trays 22 stacked one on another, to store sheets S of recording media such as paper and overhead projector (OHP) transparencies.

To make copies using the image forming apparatus 500 configured as described above, when a user presses a start button, the scanner 200 reads the contents of the document set therein. Simultaneously, a photoconductor driving motor drives the photoconductor 10, and the charging device 11 including a charging roller 11*a* uniformly charges the surface of the photoconductor 10. Subsequently, the laser writing device 21 emits a laser beam according to the contents of the document scanned by the scanner 200, thus writing a latent image on the photoconductor 10. The developing device 12 develops the electrostatic latent image with the toner into a visible image.

When the user presses the start button, a pickup roller 27 sends out the sheet S from the selected sheet tray 22. One sheet S is separated from the rest by a sheet feeding roller 28 and a separation roller 29 and fed to a feeding path R1. In the feeding path R1, multiple conveyance roller pairs 30 transport the sheet S, and the sheet S is caught in a registration roller pair 23. The registration roller pair 23 forwards the sheet S to a transfer nip, where the transfer roller 16 contacts the photoconductor 10, timed to coincide with the arrival of the toner image on the photoconductor 10.

In the transfer nip, the transfer device 17 transfers the toner image onto the sheet S from the photoconductor 10. The cleaning device 14 removes the toner remaining on the photoconductor 10 after the image transfer, and a discharger removes residual potentials from the photoconductor 10. Then, the apparatus is prepared for subsequent image formation started by the charging device 11.

Meanwhile, the sheet S is guided to the fixing device 24. While passing between the heating roller 25 and the pressure roller 26, the sheet S is heated and pressed to fix the toner image on the sheet S. Subsequently, an ejection roller pair 31 discharges the sheet S to a sheet stack section 32.

Next, a configuration and operation of the developing device 12 is described in further detail below.

Figure 3:
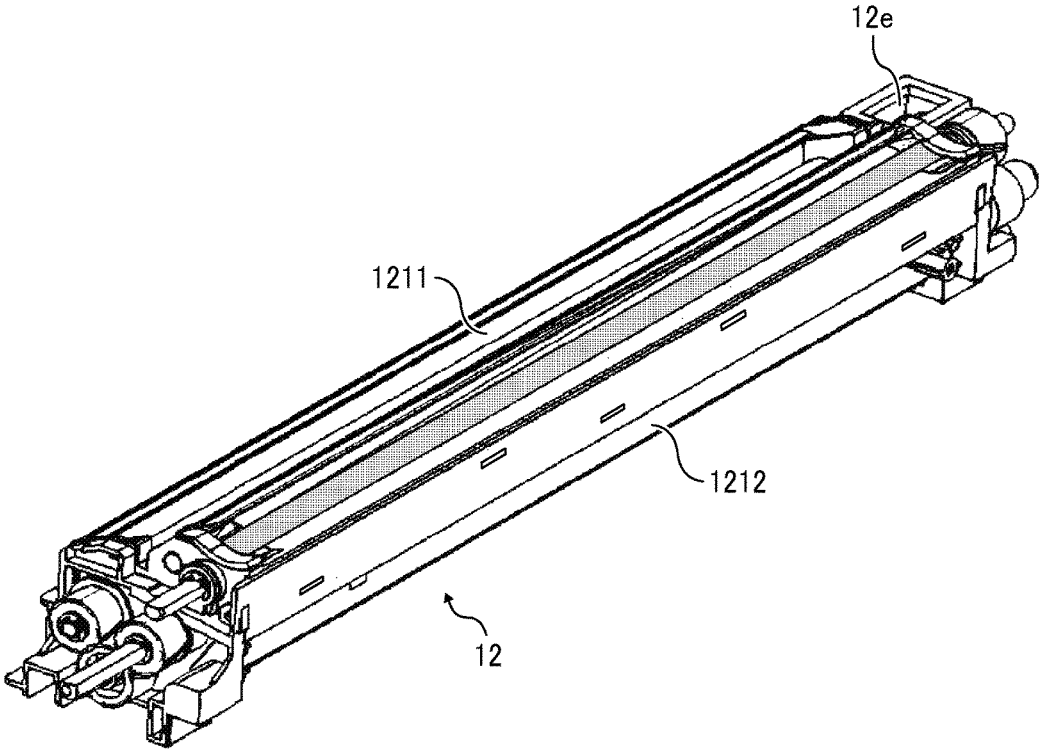
FIG. 3 is a perspective view illustrating an exterior of a developing device according to an embodiment.

FIG. 3 is a perspective view illustrating an exterior of the developing device 12.

Figure 4A:
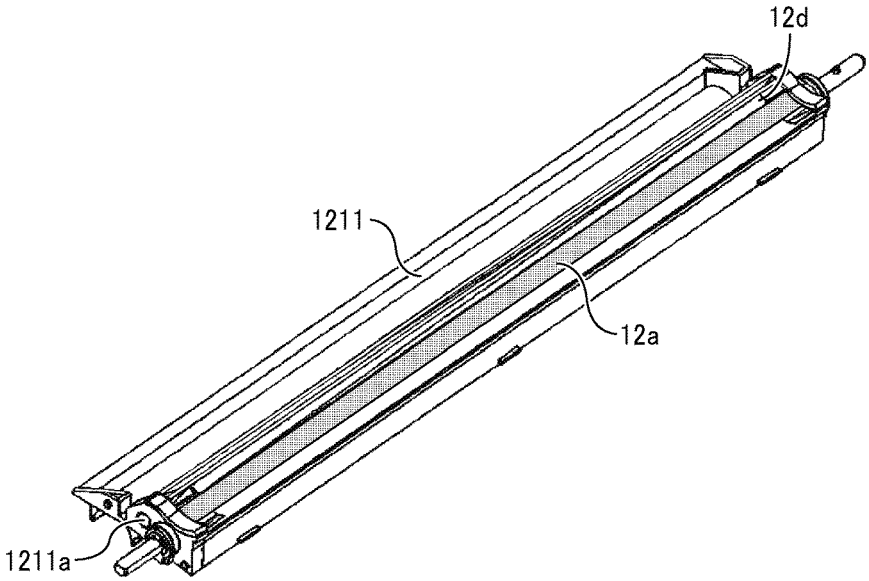
FIGS. 4A and 4B are perspective views of the developing device illustrated in FIG. 3, divided into an upper casing and a lower casing to illustrate an interior of a developer containing compartment.
Figure 4B:
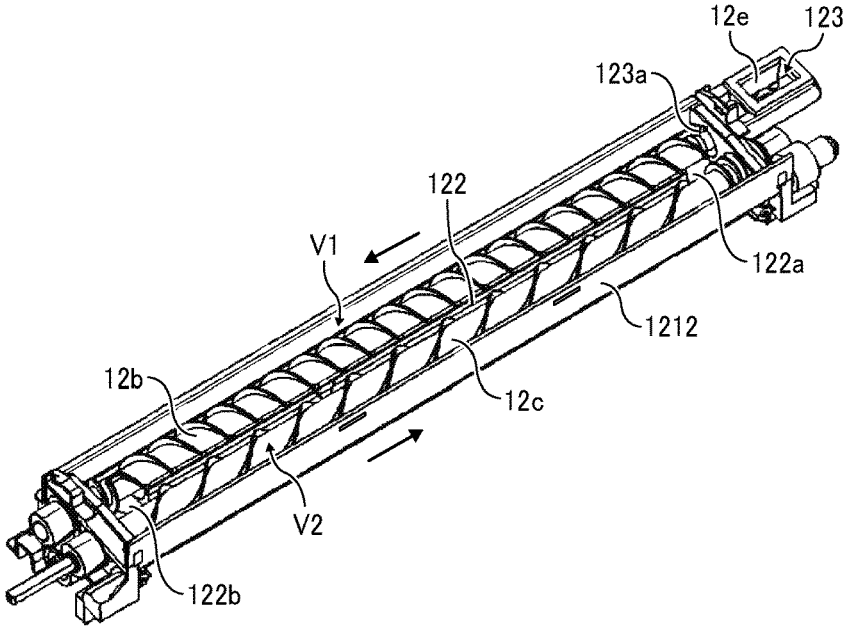

FIGS. 4A and 4B are perspective views of the developing device 12 divided into an upper casing 1211 and a lower casing 1212 to illustrate an interior of the developer containing compartment. The upper casing 1211 and the lower casing 1212 together form a developing device casing 121 (illustrated in FIG. 5).

Figure 5:
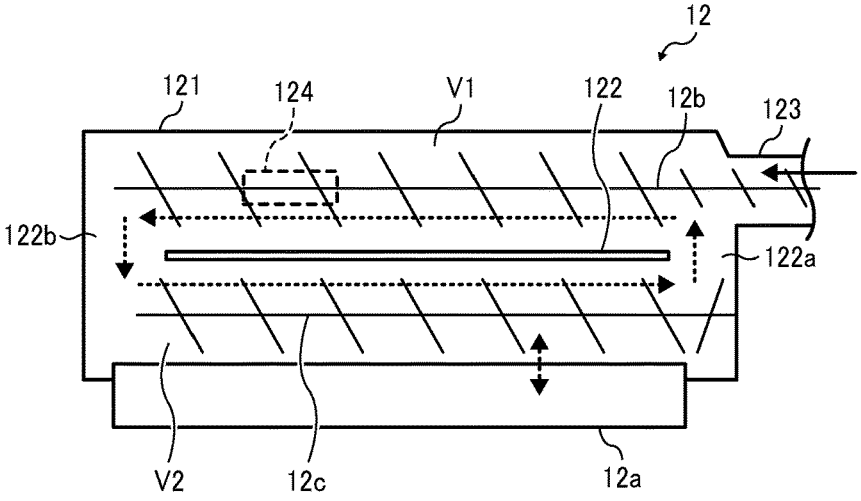
FIG. 5 is a schematic diagram illustrating a circulation passage of developer in the developing device illustrated in FIG. 3.

FIG. 5 is a schematic diagram illustrating a circulation passage of the developer in the developing device 12. In FIG. 5, broken lines represent the flow of the developer, and solid lines represent the flow of the toner supplied from a toner supply inlet 12*e*.

As illustrated in FIG. 4A, the developing roller 12*a* is rotatably supported by the upper casing 1211. The developer doctor 12*d*, which is rod-shaped, fits in holes 1211*a* in side walls of the upper casing 1211 at both ends in the longitudinal direction of the developing device 12 (an axial direction of the developing roller 12*a*).

The lower casing 1212 defines the developer containing compartment inside the developing device 12. A partition 122 divides the developer containing compartment into the first developer compartment V1 and the second developer compartment V2. The first and second conveying screws 12*b* and 12*c* are disposed in the first and second developer compartments V1 and V2, respectively. The lower casing 1212 supports the first and second conveying screws 12*b* and 12*c* rotatably. The first developer compartment V1 communicates with the first developer compartment V1 through openings 122*a* and 122*b* located at ends of the partition 122.

At the downstream end of the second developer compartment V2 in the direction in which the second conveying screw 12*c* transports the developer, the developer moves to the first developer compartment V1, through the opening 122*a* at the end of the partition 122. Inside the first developer compartment V1, while stirring the developer, the first conveying screw 12*b* transports the developer in the direction opposite the direction in which the developer moves inside the second developer compartment V2. At the downstream end of the first developer compartment V1 in the direction in which the first conveying screw 12*b* transports the developer, the developer moves through the opening 122*b* to the second developer compartment V2. Thus, the first and second conveying screws 12*b* and 12*c* disposed in the first and second developer compartments V1 and V2, respectively, circulate the developer inside the developer containing compartment partitioned by the partition 122.

The upstream end of the first developer compartment V1 in the developer conveyance direction communicates with a toner supply passage 123. The toner supply inlet 12*e* is disposed in the toner supply passage 123. Through the toner supply inlet 12*e*, fresh toner and the toner collected by the cleaning device 14 are supplied. The first conveying screw 12*b* disposed in the first developer compartment V1 extends into the toner supply passage 123. The first developer compartment V1 communicate with the toner supply passage 123 through a communication opening 123*a*. The toner supplied from the toner supply inlet 12*e* is transported by the first conveying screw 12*b* inside the toner supply passage 123 and transported to the first developer compartment V1 through the communication opening 123*a*. The toner concentration sensor 124 to detect the toner concentration of the developer is disposed below the first developer compartment V1 of the lower casing 1212.

Figure 6:
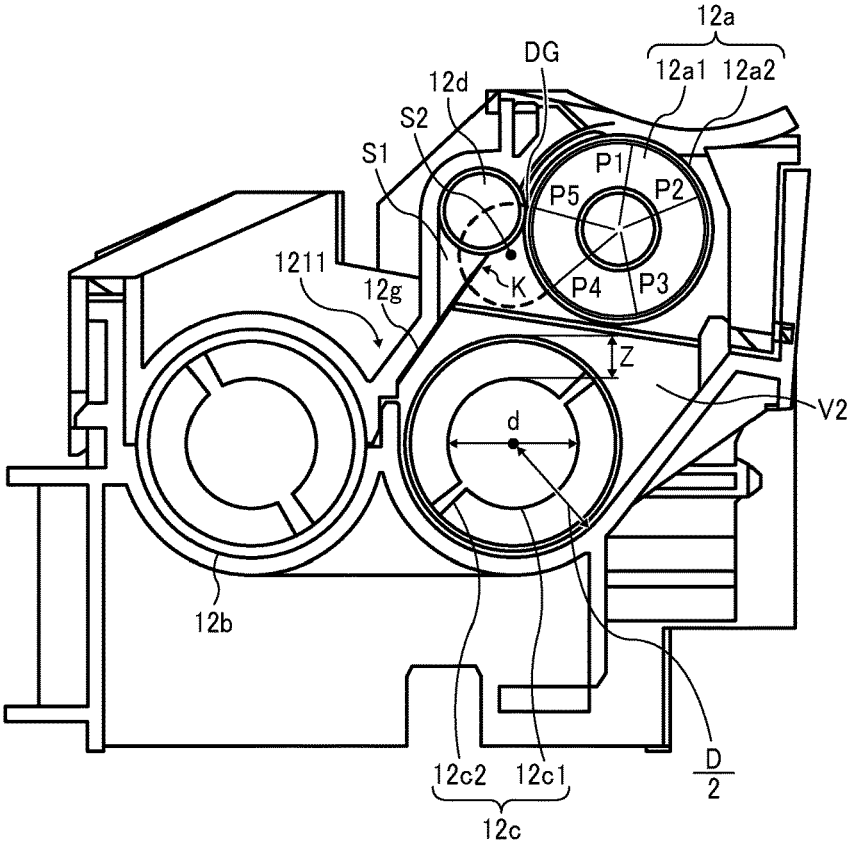
FIG. 6 is a schematic cross-sectional view of a developing device according to an embodiment.

FIG. 6 is a schematic cross-sectional view of the developing device 12 according to the present embodiment.

The developing roller 12*a* according to the present embodiment includes the developing sleeve 12*a*2 and the magnet roller 12*a*1 (i.e., the magnetic field generator) stationarily disposed inside the developing sleeve 12*a*2. The magnet roller 12*a*1 in the present embodiment is columnar and made of a mixture of resin and magnetic powder, and the surface is subjected to magnetization treatment to have five magnetic poles P1 through P5, which are peaks of magnetic-flux density in the direction normal to the surface of the developing roller 12*a* (i.e., normal magnetic-flux density). The magnetic pole P1 opposes the photoconductor 10 and hereinafter also referred to as "developing pole P1". The magnetic pole P2 exerts a magnetic force to transport the developer that has passed the developing range into the developing device casing 121 (hereinafter also "conveyance pole P2"). The magnetic pole P4 exerts a magnetic force to scoop the developer from the second developer compartment V2 (hereinafter also "developer scooping pole P4"). The magnetic pole P5 is located downstream from a doctor gap DG in the direction of rotation of the developing roller 12*a* (hereinafter also "regulation pole P5"). The magnetic pole P3 is identical in polarity to the conveyance pole P2 and exerts a magnetic force to release the developer from the developing sleeve 12*a*2 (hereinafter also "developer release pole P3").

In the present embodiment, as illustrated in FIG. 6, the developer doctor 12*d* is rod-shaped and circular in cross section. As the developer doctor 12*d*, a solid rod cut from a base material, subjected only to end-face treatment, can be used. Thus, the production cost can be low. Additionally, when the developer doctor 12*d* is press-fitted into the upper casing 1211, which supports the developing roller 12*a* rotatably, as illustrated in FIG. 4A, the positions of the developer doctor 12*d* and the developing roller 12*a* can be determined relative to an identical component. Accordingly, the accumulation of dimensional tolerance can be kept minimum, and the doctor gap DG, which is a gap between the developing roller 12*a* and the developer doctor 12*d*, can be formed with a high degree of accuracy.

The carrier of the developer is not consumed but remains in the developing device. The carrier deteriorates over time while being used. Accordingly, the carrier is replaced regularly. If the developer containing compartment contains a large amount of developer, at replacement, a large amount of degraded carrier is discarded, which is a large environmental load. In the present embodiment, to alleviate the environmental load, the amount of the developer contained in the developer containing compartment is reduced. As the amount of the developer contained in the developer containing compartment decreases, the weight of the developing device 12 decreases, and the energy to transport the device is reduced. Additionally, the load of rotation of the first and second conveying screws 12*b* and 12*c* decreases, thereby reducing the energy to operate the developing device 12. Thus, the environmental load can be reduced further.

However, the reduction in the amount of developer contained in the developer containing compartment can reduce the amount of developer scooped onto the developing roller 12*a*, resulting in decreases in image density. In view of the foregoing, the present embodiment has the following feature to attain desirable images even when the amount of developer contained in the developer containing compartment is reduced.

In the present embodiment, as illustrated in FIG. 6, a diameter d of the shaft 12*c*1 of the second conveying screw 12*c* is made greater than a radius D/2 of the second conveying screw 12*c*. With the shaft 12*c*1 of the second conveying screw 12*c* designed as described above, the capacity of the second developer compartment V2 is reduced, and the level of the developer in the second developer compartment V2 is raised. Accordingly, even in the configuration in which the amount of developer in the developer containing compartment is reduced, decreases in the level of the developer in the second developer compartment V2 are inhibited. Then, the spiral blade 12*c*2 of the second conveying screw 12*c* can bring up the developer close to the developing roller 12*a*, and the developer scooping pole P4 of the second developer compartment V2 can attract the developer. Accordingly, even when the amount of developer contained in the developing device casing is reduced, decreases in the amount of the developer scooped are inhibited.

As the amount of developer in the second developer compartment V2 is reduced, the amount of developer scooped with the magnetic force of the developer scooping pole P4 decreases. When the second developer compartment V2 contains a large amount of developer and most of the developer in the second developer compartment V2 is present in a range where the magnetic force of the developer scooping pole P4 acts on the developer, the developer scooping pole P4 can directly scoop the developer in the second developer compartment V2 with the magnetic force thereof. However, as the amount of developer in the second developer compartment V2 is reduced, the amount of developer positioned in the range where the magnetic force of the developer scooping pole P4 acts decreases, and the amount of developer scooped directly by the developer scooping pole P4 decreases. In this case, the magnetic force exerted by the developer scooping pole P4 mainly scoops the developer lifted by the spiral blade 12*c*2 of the second conveying screw 12*c* to the range of magnetic force of the developer scooping pole P4. Accordingly, around the position where the developing roller 12*a* opposes the spiral blade 12*c*2 of the second conveying screw 12*c*, a sufficient amount of developer is borne on the developing roller 12*a*. However, it is possible that the developer is rarely borne on a portion that does not oppose the spiral blade 12*c*2. Accordingly, the amount of developer borne on the developing roller 12*a* becomes uneven corresponding to the screw-blade pitch of the second conveying screw 12*c*. When the developer passes the developer doctor 12*d*, the developer blocked by the developer doctor 12*d* flows to a portion where the amount of developer is smaller, and the unevenness in the amount of developer borne on the developing roller 12*a* is alleviated to some extent. The amount of developer, however, is not fully equalized since the amount of developer scooped is insufficient. As a result, the image density of developed images becomes uneven corresponding to the screw-blade pitch of the conveying screw.

Therefore, in the present embodiment, the developing device 12 further includes a guide 12*g* to inhibit the developer flipped up from the second conveying screw 12*c* from falling to the second developer compartment V2 and guide the developer to be borne on the developing roller 12*a*.

The guide 12*g* is made of a resin material such as polyethylene terephthalate (PET) and is shaped into a sheet having a thickness of about 0.2 mm. The guide 12*g* faces the second conveying screw 12*c* from above. The guide 12*g* is attached to the developing device casing 121 in an inclined posture such that a first end side of the guide 12*g* (on the side of the developing roller 12*a*) is positioned upper than a second end side thereof (on the side of the second conveying screw 12*c*). Further, the guide 12*g* extends to a position close to the doctor gap DG, which is the gap between the developer doctor 12*d* and the developing roller 12*a*, and a first end 12*g*E (illustrated in FIGS. 11A and 11B) of the guide 12*g* abuts against the developer doctor 12*d* such that the guide 12*g* is bent with the first end 12*g*E oriented to the developing roller 12*a*. A second end of the guide 12*g* is attached to an inner face of the upper casing 1211, serving as an upper wall of the second developer compartment V2. The second end (lower end) of the guide 12*g* is lower than a top position of the second conveying screw 12*c* by a distance Z (mm). The lower end of the guide 12*g* and a top position of the shaft 12*c*1 of the second conveying screw 12*c* are disposed at a similar height. Thus, in FIG. 6, the distance Z is expressed as the distance between the op position of the second conveying screw 12*c* and the top position of the shaft 12*c*1.

In a vertical direction, a certain clearance is provided between a bottom position of the developing roller 12*a* and the top position of the second conveying screw 12*c*.

Additionally, the guide 12*g* is disposed such that a portion of the guide 12*g* is in the range of normal magnetic-flux density of the developer scooping pole P4. Specifically, a portion of the guide 12*g* is disposed in a range of normal magnetic-flux density generated between the developer scooping pole P4 and the regulation pole P5, indicated by broken lines in FIG. 6. The guide 12*g* extends from one end to the other end of the second conveying screw 12*c*. Thus, the guide 12*g* is long in the developer conveyance direction (i.e., the axial direction) of the second conveying screw 12*c*.

It is preferable that the guide 12*g* is longer than the upper casing 1211 in the axial direction of the second conveying screw 12*c*, and both ends of the guide 12*g* in that direction are bent toward the second conveying screw 12*c* and disposed in contact with inner faces of side walls of the upper casing 1211 that are perpendicular to the developer conveyance direction. This configuration can inhibit the developer from scattering from between the guide 12*g* and the inner face of the side wall of the upper casing 1211 into a space S1 illustrated in FIG. 6. The space S1 is enclosed by the upper casing 1211, the developer doctor 12*d*, and the guide 12*g*.

Additionally, in such a configuration, both ends of the guide 12*g* in the developer conveyance direction are preferably not secured to but disposed to slidably contact the inner faces of the side walls of the upper casing 1211 (perpendicular to the developer conveyance direction). As described later, due to the pressure from the developer borne on the developing roller 12*a*, the first end side of the developer doctor 12*d* (on the side of the developer doctor 12*d*) can deform to draw away from the developing roller 12*a*. In a configuration in which both ends of the guide 12*g* in the developer conveyance direction are secured to the side walls of the upper casing 1211, when the deformation is greater in a center portion than in the end portion in the developer conveyance direction (the axial direction), the side walls of the upper casing 1211 may be pulled inwardly, and the upper casing 1211 may deform. By contrast, in the configuration in which both ends of the guide 12*g* in the developer conveyance direction are not secured to the side walls of the upper casing 1211, the side walls of the upper casing 1211 are not pulled inwardly. Therefore, deformation of the upper casing 1211 can be inhibited when both ends of the guide 12*g* in the developer conveyance direction are not secured to the side walls of the upper casing 1211.

Figure 7:
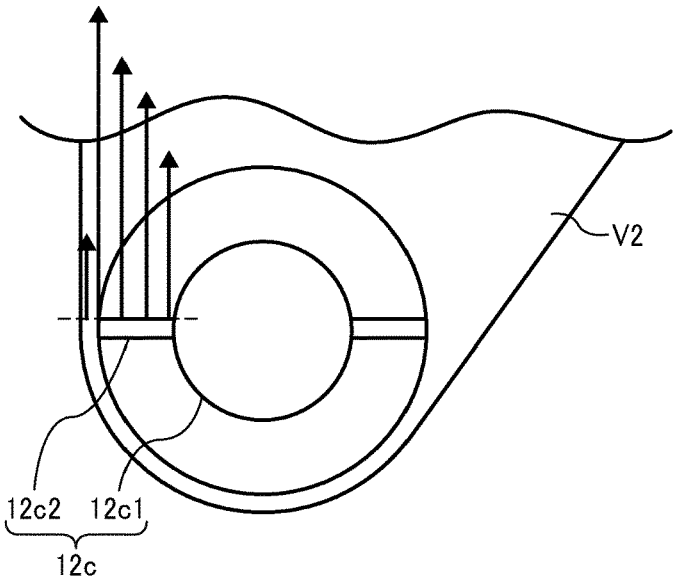
FIG. 7 is a schematic diagram illustrating a speed distribution of developer in a range indicated by broken lines in FIG. 6 at a moment when a spiral blade of a second conveying screw is horizontal.

FIG. 7 is a schematic diagram illustrating distribution of speed of developer in the range indicated by broken lines in FIG. 6 at a moment when the spiral blade 12*c*2 of the second conveying screw 12*c* is horizontal.

The second conveying screw 12*c* rotates clockwise in the drawings, and the spiral blade 12*c*2 of the second conveying screw 12*c* lifts the developer in the second developer compartment V2, along the side wall (on the left in the drawings) of the second developer compartment V2 (a face of the partition 122). As illustrated in FIG. 7, the speed of the developer directly receiving the force of the spiral blade 12*c*2 increases as the position approaches the outer circumference of the second conveying screw 12*c*. The speed of the developer located between the second conveying screw 12*c* and the side wall is slower.

Until the spiral blade 12*c*2 becomes horizontal, the spiral blade 12*c*2 pushes the developer toward the wall face shaped along the circumference of the second conveying screw 12*c*. Accordingly, the developer does not leave the spiral blade 12*c*2 but is lifted thereby. However, as illustrated in FIG. 7, when the spiral blade 12*c*2 is horizontal, a wide space extends in the direction in which the developer moves. Accordingly, when the spiral blade 12*c*2 is horizontal, a portion of the developer lifted by the spiral blade 12*c*2 leaves the spiral blade 12*c*2 and moves up. Consequently, the amount of developer lifted to the position adjacent to the developing roller 12*a* by the spiral blade 12*c*2 decreases, and the amount of developer scooped onto the developing roller 12*a* with the magnetic force of the developer scooping pole P4 decreases.

Additionally, in the configuration in which the guide 12*g* is not provided, most of the developer moving up from the spiral blade 12*c*2 does not move to the developing roller 12*a* but falls to the second developer compartment V2 under the gravity. At that time, the developer collides with the developer subsequently lifted by the spiral blade 12*c*2. Then, it is possible that the developer subsequently lifted by the spiral blade 12*c*2 is returned. Consequently, the amount of developer lifted to the position adjacent to the developing roller 12*a* by the spiral blade 12*c*2 further decreases, and the amount of developer scooped onto the developing roller 12*a* with the magnetic force of the developer scooping pole P4 decreases.

By contrast, in the present embodiment including the guide 12*g*, as illustrated in FIG. 6, the developer flipped up from the spiral blade 12*c*2 contacts an inclined face K of the guide 12*g* (e.g., an inclined plate) that is inclined relative to the axial direction of the second conveying screw 12*c* such that the first end of the guide 12*g* (on the side of the developing roller 12*a*) is positioned higher than the opposite end adjacent to the wall of the second developer compartment V2. Contacting the inclined face K, the developer is directed to the developing roller 12*a*. While moving toward the developing roller 12*a*, the developer enters the range of the normal magnetic-flux density of the developer scooping pole P4 and is attracted by the magnetic force of the developer scooping pole P4. Then, the developer is borne on the surface of the developing roller 12*a*. Thus, the developing roller 12*a* can carry the developer flipped from the second conveying screw 12*c*, in addition to the developer lifted to the position adjacent to the developing roller 12*a* by the spiral blade 12*c*2 and scooped onto the developing roller 12*a*.

Further, the guide 12*g* inhibits the developer flipped up by the spiral blade 12*c*2 from falling to the second developer compartment V2. Thus, the developer subsequently lifted by the spiral blade 12*c*2 can be inhibited from colliding with the developer falling to the second developer compartment V2. Consequently, decreases in the amount of developer lifted to the position adjacent to the developing roller 12*a* by the spiral blade 12*c*2 are suppressed, thereby increasing the amount of developer scooped onto the developing roller 12*a* with the magnetic force of the developer scooping pole P4.

Thus, the guide 12*g* can increase the amount of developer borne on the developing roller 12*a*. Consequently, the thickness of a layer of developer borne on the developing roller 12*a* can be increased. Accordingly, at the position where the developer lifted by the spiral blade 12*c*2 is scooped onto the developing roller 12*a*, the difference between the doctor gap DG and the thickness of the layer of developer in the portion (where the amount of developer is smaller) that does not oppose the spiral blade 12*c*2 can be reduced. Additionally, the amount of developer increases in the portion opposing the spiral blade 12*c*2 at the position where the developer lifted by the spiral blade 12*c*2 is scooped onto the developing roller 12*a*, and the amount of developer blocked by the developer doctor 12*d* can increase. Thus, after the developer in that portion is blocked by the developer doctor 12*d*, a greater amount of developer can flow in the axial direction to the portion that does not oppose the spiral blade 12*c*2, where the amount of developer is smaller. Thus, downstream from the doctor gap DG, the amount of developer can be equalized, and, in developed images, uneven image density corresponding to the screw-blade pitch of the second conveying screw 12*c* is suppressed.

The guide 12*g* is inclined relative to the vertical direction to linearly ascend from the second end thereof (adjacent to the wall of the second developer compartment V2) to the first end (close to the developing roller 12*a*). The guide 12*g* provides the inclined face K inclined such that the first end side close to the developing roller 12*a* is higher than the second end close to the developing roller 12*a*. The inclined face K can alleviate decreases in the speed of the developer flipped up from the spiral blade 12*c*2. The inclined face K can guide, at a speed at which the developing roller 12*a* can carry the developer, the developer that has contacted the guide 12*g*.

The second end of the guide 12*g* on the side of the second developer compartment V2 is lower than the top position of the second conveying screw 12*c* by the distance Z (mm). Compared with a configuration in which the second end of the guide 12*g* is higher than the top position of the second conveying screw 12*c*, disposing the second end of the guide 12*g* lower than the top position of the second conveying screw 12*c* can reduce the distance for the developer flipped up from the spiral blade 12*c*2 to travel to the range of the normal magnetic-flux density of the developer scooping pole P4.

Immediately after being flipped from the spiral blade 12*c*2, the developer starts decelerating due to the gravity. As the distance to the range of normal magnetic-flux density of the developer scooping pole P4 increases, the developer loses the momentum before reaching that range. Then, the developer falls to the second developer compartment V2. When the second end of the guide 12*g* (on the side of the second developer compartment V2) is lower than the top position of the second conveying screw 12*c*, the developer can reach the range of normal magnetic-flux density of the developer scooping pole P4 before losing the momentum. Thus, the developer flipped up by the spiral blade 12*c*2 is inhibited from falling to the second developer compartment V2.

In particular, the developer flipped up vertically is preferably guided by the guide 12*g* to the developing roller 12*a* as illustrated in FIG. 7. When the second conveying screw 12*c* rotates clockwise from the state illustrated in FIG. 7, the flipped developer moves obliquely to the upper right in the drawing. In FIG. 6, the developing roller 12*a* is at the upper right from the second conveying screw 12*c*. Accordingly, when the second conveying screw 12*c* rotates clockwise from the state illustrated in FIG. 7, the developer flipped from the spiral blade 12*c*2 moves toward the developing roller 12*a*. Consequently, the developer can be borne on the developing roller 12*a* even when the guide 12*g* does not guide the developer.

Figure 8:
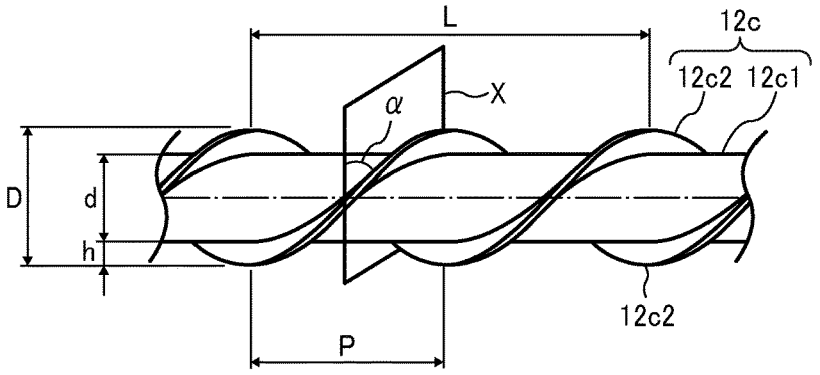
FIG. 8 is an enlarged view of a main part of the second conveying screw.

FIG. 8 is an enlarged view of a main part of the second conveying screw 12*c*.

The second conveying screw 12*c* illustrated in FIG. 8 is a double threaded screw. A lead L (the amount of axial advance of a point accompanying a complete turn of the screw thread) and an outer diameter D of the second conveying screw 12*c* are in the relation represented as $0.25 \leq (D/L) \leq 0.5$. When the lead L is long, the spiral blade 12*c*2 lies low and lifts the developer desirably. Then, the spiral blade 12*c*2 can bring up a greater amount of developer close to the developing roller 12*a*, thereby increasing the amount of developer scooped by the developer scooping pole P4 onto the developing roller 12*a*. Although the spiral blade 12*c*2 lying low increases the amount of developer flipped vertically up, the guide 12*g* can guide the flipped developer to be borne on the developing roller 12*a*. Consequently, the developing roller 12*a* can bear a sufficient amount of developer.

If the spiral blade 12*c*2 lies too low, the capability to transport the developer in the axial direction decreases, and the amount of developer on the downstream side in the developer conveyance direction (axial direction) decreases. As a result, the amount of developer borne on the downstream side of the developing roller 12*a* in the developer conveyance direction (axial direction) becomes extremely small. When $0.25 \leq (D/L) \leq 0.5$ is satisfied, the degradation of the capability to transport the developer in the developer conveyance direction (axial direction) is alleviated, thereby suppressing the decrease in the amount of developer borne on the downstream side of the developing roller 12*a* in the axial direction.

Additionally, in the present embodiment, the guide 12*g* extends close to the doctor gap DG to reduce a space S2 positioned upstream from the developer doctor 12*d* in the rotation direction of the developing roller 12*a*.

Figure 9:
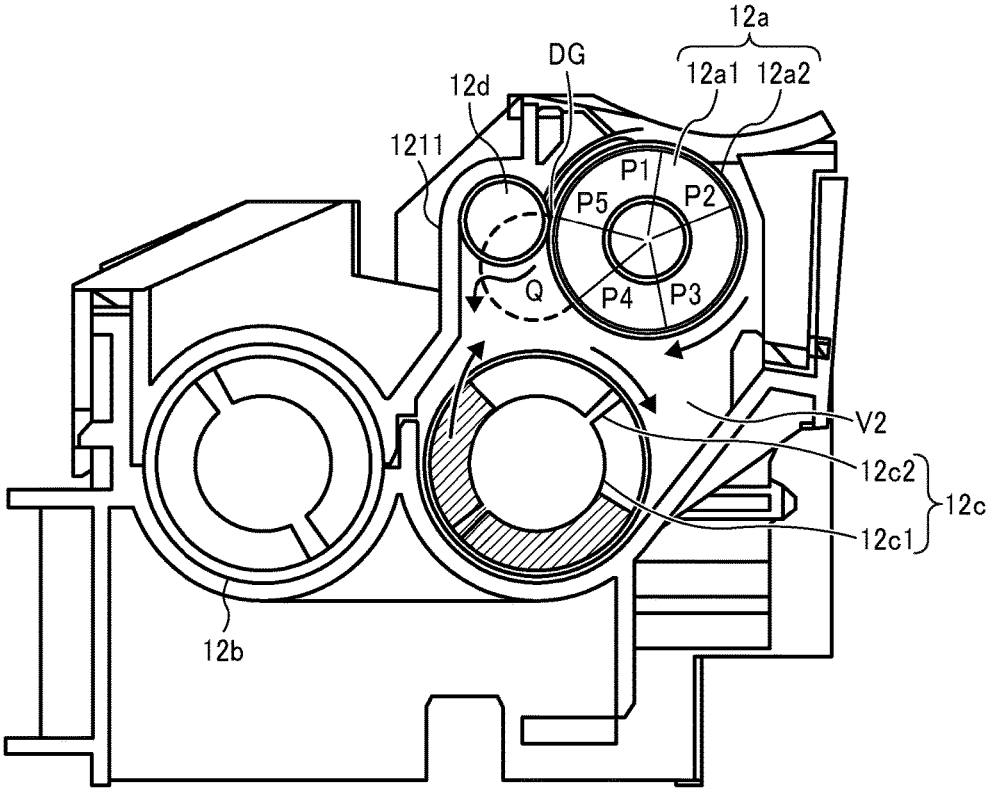
FIG. 9 illustrates movement of developer in a developing device that does not include a guide to guide developer flipped from a conveying screw.

The developer blocked by the developer doctor 12*d* is pushed by subsequent developer. In a configuration illustrated in FIG. 9, in which the guide 12*g* is not provided, a large space is present upstream from the developer doctor 12*d* in the rotation direction of the developing roller 12*a*. As a result, when the developer blocked by the developer doctor 12*d* is pushed by the subsequent developer, a portion of the pushed developer moves in a direction drawing away from the developing roller 12*a*, as indicated by arrow Q in FIG. 9. The developer moving away from the developing roller 12*a* exits the range of the normal magnetic-flux density of the developer scooping pole P4, falls along the wall of the upper casing 1211 to the second developer compartment V2, and is not used in image developing.

However, in the present embodiment, the guide 12*g* extends close to the doctor gap DG to reduce the space S2 positioned upstream from the developer doctor 12*d* in the rotation direction of the developing roller 12*a*. Additionally, the guide 12*g* extends into the range of the normal magnetic-flux density of the developer scooping pole P4. Consequently, even when the developer blocked by the developer doctor 12*d* is pushed by the subsequent developer, the guide 12*g* can inhibit the developer from moving away from the developing roller 12*a*. Then, the developer blocked by the developer doctor 12*d* can be kept in the range of the normal magnetic-flux density of the developer scooping pole P4 and inhibited from falling to the second developer compartment V2. Consequently, the developer can accumulate on the upstream side of the doctor gap DG in the direction of rotation of the developing roller 12*a*. Consequently, even when the developer scooped onto the developing roller 12*a* is uneven in the axial direction, the developer is leveled by the time the developer passes through the doctor gap DG. Thus, downstream from the doctor gap DG, the amount of developer can be equalized, and uneven image density of developed images can be suppressed.

The guide 12*g* abuts against the developer doctor 12*d*. That is, the first end 12*g*E (in FIG. 11A) of the guide 12*g* is in contact with the developer doctor 12*d*. This configuration can inhibit the developer from scattering from between the guide 12*g* and the developer doctor 12*d* into the space S1 illustrated in FIG. 6, enclosed by the upper casing 1211, the developer doctor 12*d*, and the guide 12*g*.

The guide 12*g* can be either a rigid plate or an elastic sheet that deforms easily. When the guide 12*g* is an elastic body, the guide 12*g* can deform to contact the developer doctor 12*d* even when the dimension of the guide 12*g* is not precise but is longer than a specified dimension to some extent. Thus, the dimensional accuracy of the guide 12*g* can be relaxed.

Figure 10A:
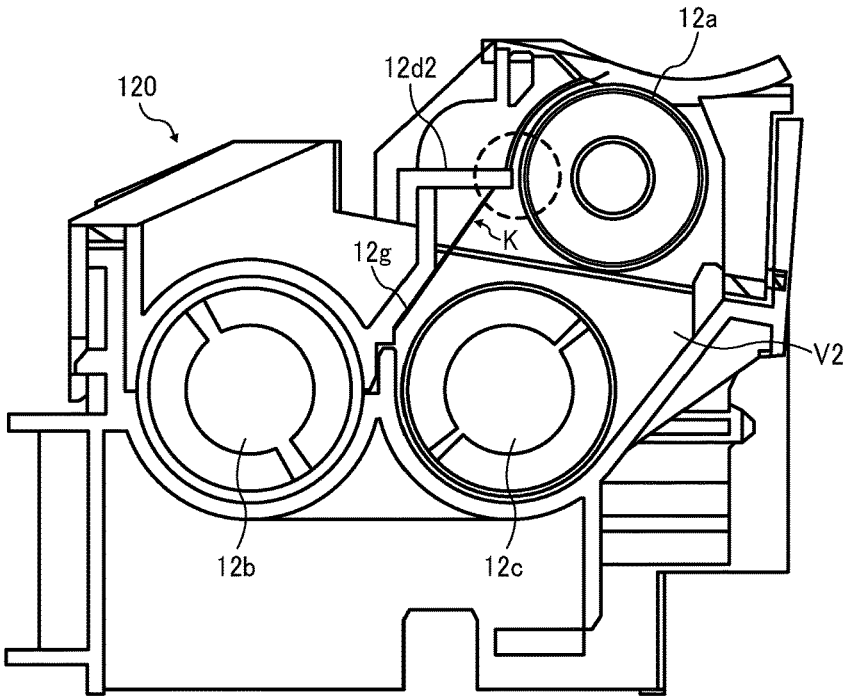
FIG. 10A is a schematic cross-sectional view of a developing device including a doctor blade as a developer regulator.
Figure 10B:
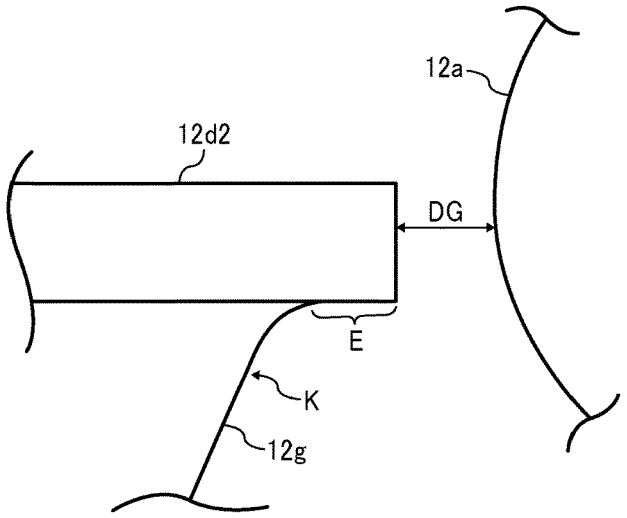
FIG. 10B is an enlarged view of an area enclosed with broken lines in FIG. 10A.

FIG. 10A is a schematic cross-sectional view of a developing device 120 that includes a doctor blade 12*d*2 as a developer regulator instead of the rod-shaped developer doctor 12*d*. FIG. 10B is an enlarged view of an area enclosed with broken lines in FIG. 10A. The developing device 120 has a structure similar to the structure of the developing device 12 illustrated in FIG. 6 except that the developer regulator is blade-shaped.

As illustrated in FIG. 10B, it is difficult to disposed the guide 12*g* in contact with (abutting against) an end of the doctor blade 12*d*2 due to variations of component. The guide 12*g* abuts against the doctor blade 12*d*2 at a position away from the end of the doctor blade 12*d*2 defining the doctor gap DG. The clearance between the guide 12*g* and the developing roller 12*a* decreases progressively toward the doctor gap DG. However, when the position where the guide 12*g* abuts against the doctor blade 12*d*2 (i.e., an abutting position) is away from the end of the doctor blade 12*d*2, the clearance between the guide 12*g* and the doctor blade 12*d*2 is sharply narrowed from the abutting position. Consequently, the developer guided by the guide 12*g* toward the doctor gap DG is dammed by an end portion E of the doctor blade 12*d*2. The dammed developer is less likely to flow to the doctor gap DG and more likely to remain adjacent to the doctor gap DG. The remaining developer is pushed to the doctor blade 12*d*2 by the subsequent developer and adheres to the end portion E.

By contrast, in the present embodiment, in which the rod-shaped developer doctor 12*d* is used as the developer regulator, even when the position where the guide 12*g* abuts against the developer doctor 12*d* varies, the guide 12*g* and the circumference of the rod-shaped developer doctor 12*d* define a mildly inclined face such that the distance to the developing roller 12*a* decreases progressively toward the doctor gap DG. Thus, the guide 12*g* and the circumference of the developer doctor 12*d* define an inclined face that opposes the surface of the developing roller 12*a* and follows the flow of the developer toward the doctor gap DG. As a result, the developer pushed by the subsequent developer contacts the inclined face defined by the guide 12*g* and the circumference of the developer doctor 12*d* and moves along the inclined face to the doctor gap DG. Accordingly, the configuration illustrated in FIG. 6 inhibits the developer from being remaining and guides the developer so that the developer smoothly moves toward the doctor gap DG and gradually becomes dense. Thus, the developer is inhibited from adhering to the guide 12*g* or the developer doctor 12*d*. Since the developer moves to the doctor gap DG while becoming dense, even when the developer is unevenly scooped onto the developing roller 12*a*, the developer can be leveled by the time the developer passes through the doctor gap DG. Thus, downstream from the doctor gap DG, the amount of developer can be equalized and uneven image density of developed images can be suppressed.

Figure 11A:
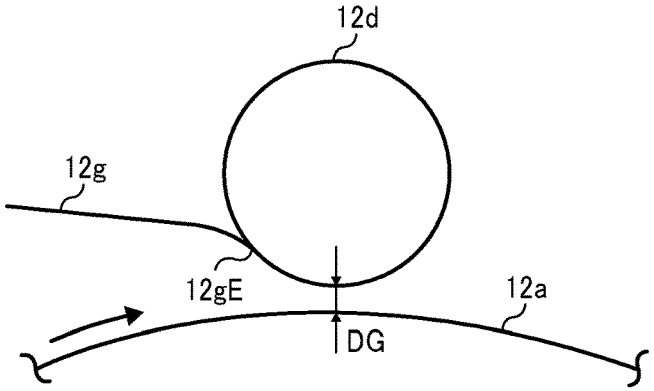
FIG. 11A is a schematic diagram in which the guide abuts against the developer doctor in a bent posture with an end of the guide oriented to the developing roller.
Figure 11B:
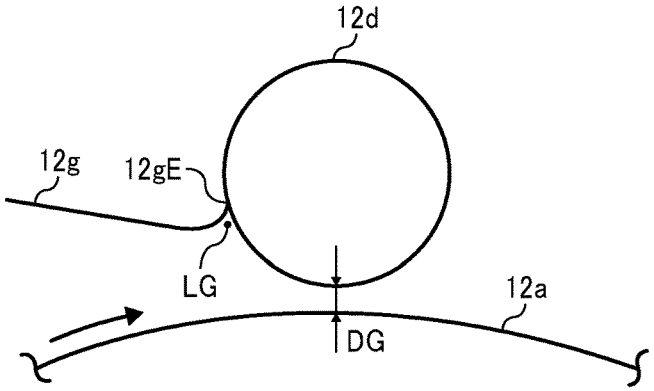
FIG. 11B is a schematic diagram in which the guide is bent with the end thereof oriented to the side opposite the developing roller.

When the guide 12*g* abutting against the developer doctor 12*d* is bent such that the first end 12*g*E of the guide 12*g* is oriented to the developing roller 12*a*, the advantage described below with reference to FIGS. 11A and 11B is attained, compared with a case where the guide 12*g* is bent to orient the first end 12*g*E thereof to the side opposite the developing roller 12*a*.

FIG. 11A is a schematic diagram in which the guide 12*g* abutting against the developer doctor 12*d* is bent with the first end 12*g*E thereof oriented to the developing roller 12*a*. FIG. 11B is a schematic diagram in which the guide 12*g* is bent with the first end 12*g*E thereof oriented to the side opposite the developing roller 12*a*.

As illustrated in FIG. 11B, when the guide 12*g* is bent so that the first end 12*g*E thereof is oriented to the side opposite the developing roller 12*a*, the developer doctor 12*d* and the bent portion of the guide 12*g* define a wedgewise gap LG. Although the clearance between the guide 12*g* and the developing roller 12*a* decreases gradually toward the doctor gap DG, the clearance abruptly widens with the bent portion of the guide 12*g*. The bent portion of the guide 12*g* may divert the direction of the developer guided by the guide 12*g* to a direction away from the developing roller 12*a*. There arises a risk that the developer enters the wedgewise gap LG and remains there.

By contrast, as illustrated in FIG. 11A, when the guide 12*g* is bent so that the first end 12*g*E thereof is oriented to the developing roller 12*a*, the guide 12*g* is coupled to the developer doctor 12*d* so that the clearance between the guide 12*g* and the developing roller 12*a* decreases progressively. The guide 12*g* is coupled to the developer doctor 12*d* so that the guide 12*g* is shaped to follow the flow of the developer to the doctor gap DG. Accordingly, the bent portion of the guide 12*g* does not retain the developer, and the guide 12*g* guides the developer smoothly to the doctor gap DG.

In the present embodiment, the amount of the developer contained in the developer containing compartment is reduced. When the amount of developer contained in the developer containing compartment is reduced significantly, there is the following risk. While images that consume a large amount of toner (e.g., solid images extending entirely) are consecutively output, the concentration of toner in the developer contained in the second developer compartment V2 has variations in the developer conveyance direction of the second conveying screw 12*c*. Specifically, while the toner concentration is kept at or similar to a prescribed concentration on the upstream side in the developer conveyance direction of the second conveying screw 12*c*, the toner concentration decreases from the prescribed concentration as the position goes downstream in that direction. As a result, when images that consume a large amount of toner are consecutively output, the image density of developed images may be uneven in a main scanning direction (the axial direction of the developing roller 12*a*).

In view of the foregoing, in the present embodiment, when images that consume a large amount of toner are consecutively output, the rotation speed of each conveying screw is increased to increase the speed of developer conveyance in the developer containing compartment. The developer returns to the second developer compartment V2 after the toner therein is consumed in the developing range and the toner concentration is reduced. When the speed of developer conveyance in the developer containing compartment is increased, such developer having a reduced toner concentration can be promptly transported to the first developer compartment V1. Additionally, the developer moved from the first developer compartment V1 to the second developer compartment V2, having the prescribed toner concentration, can be promptly transported to the downstream side in the developer conveyance direction of the second conveying screw 12*c*. Thus, increases in the rotation speed of the first and second conveying screws 12*b* and 12*c* can enhance the circulation efficiency of developer to suppress the variations in the toner concentration in the developer in the second developer compartment V2.

The variations in the toner concentration in the developer in the second developer compartment V2 are not fully suppressed unless a lead angle α and a screw-blade pitch P (illustrated in FIG. 8) of the second conveying screw 12*c* are properly set. As illustrated in FIG. 8, the lead angle α of the second conveying screw 12*c* is an angle between a face of the spiral blade 12*c*2 and a virtual plane X perpendicular to the rotation axis (e.g., the shaft 12*c*1) of the second conveying screw 12*c*. The lead angle α, the lead L, the screw-blade pitch P, a thread number (number of threads), and the outer diameter D of the second conveying screw 12*c* satisfy L=nP and tan α=(Pn/πD).

In the present embodiment, the lead angle α is greater than or equal to 35.1° and smaller than or equal to 45° (in a range of from 35.1° to 45°), and the ratio (P/h) of the screw-blade pitch P relative to a blade height h of the spiral blade 12*c*2 is greater than or equal to 3.33 and smaller than or equal to 5.67 (in a range of from 3.33 to 5.67). The effects of this setting are described later with reference to results of an experiment. In a configuration in which the lead angle α exceeds 45°, a greater amount of developer is flipped from the spiral blade 12*c*2 as illustrated in FIG. 7 when the second conveying screw 12*c* rotates at a high speed. As described above, the guide 12*g* guides the developer flipped from the spiral blade 12*c*2 to be borne on the developing roller 12*a*. Thus, the developer that has passed through the developing range and reduced in toner concentration (hereinafter "post-development developer") is repeatedly borne on the developing roller 12*a* and is not transported to the first developer compartment V1. As a result, even when the rotation speed of the second conveying screw 12*c* is increased, the circulation efficiency of developer is not enhanced, and the variations in the toner concentration in the developer are not fully suppressed.

By contrast, in a configuration in which the lead angle α is smaller than 35.1°, the capability of the spiral blade 12*c*2 to stir and mix the developer in the second developer compartment V decreases. As a result, the post-development developer is not sufficiently mixed with the developer having the prescribed toner concentration. Then, dispersibility is degraded. Further, the amount of developer moving in the axial direction per one rotation of the second conveying screw 12*c* is smaller. Accordingly, to attain a developer conveyance speed at which variations in the toner concentration are suppressed, it is necessary to increase the rotation speed of the conveying screws. However, when the rotation speed of the conveying screws is extremely high, the bearings to rotatably attach the conveying screws to the lower casing 1212 are heated, and the toner in developer may agglomerate due to the heat. Due to the heat of the bearings, the toner may melt and firmly adhere to portions of the lower casing 1212 adjacent to the bearings. Further, it is possible that the amount of developer lifted by the spiral blade 12*c*2 decreases to lower the image density.

Even when the lead angle α ranges from 35.1° to 45°, inconveniences can arise if the number of threads is large and the screw-blade pitch P is narrow. That is, when the toner concentration is high under hot and humid conditions, degraded developer having poor flowability may get stuck between the winding threads of the spiral blade 12*c*2, which is an inconvenience called "developer lock". By contrast, if the number of threads is small and the screw-blade pitch P is too wide, the level of developer becomes uneven between the portion where the spiral blade 12*c*2 is present and the rest. Then, the uneven image density corresponding to the screw-blade pitch P can easily occur. When the screw-blade pitch P is too wide, the developer is likely to escape, and the amount of developer pushed in the axial direction by the spiral blade 12*c*2 decreases. Accordingly, the amount of developer transported in the axial direction per unit time decreases. In such a state, to attain a developer conveyance speed at which variations in the toner concentration are suppressed, a significant increase in the rotation speed of the conveying screws is necessary.

A desirable range of the screw-blade pitch P depends on the blade height h. When the blade height h is relatively high, the shaft and the screw blade of the conveying screw surround the developer adjacent to the shaft, inhibiting the developer from moving. Additionally, as the conveying screw rotates, the surface of the shaft and the screw blade move in the rotation direction, and a shearing force acts on the developer. If the diameter of the shaft is reduced to increase the blade height h, the surface of the shaft and portions of the screw blade adjacent to the shaft rotate at a slower speed. Consequently, the shearing force acting on the developer weakens. Then, the developer is likely to aggregate, and the developer lock occurs easily.

Figure 12A:
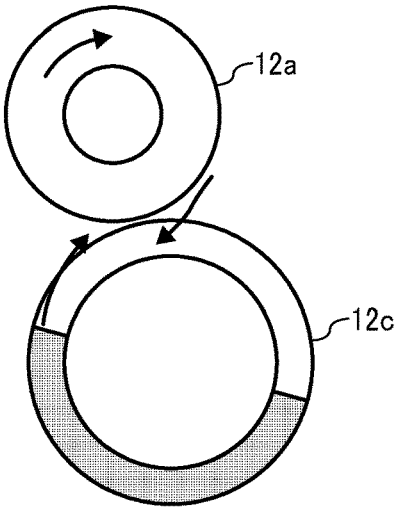
FIGS. 12A and 12B illustrate a conveying screw that is larger in size than a developing roller.
Figure 12B:
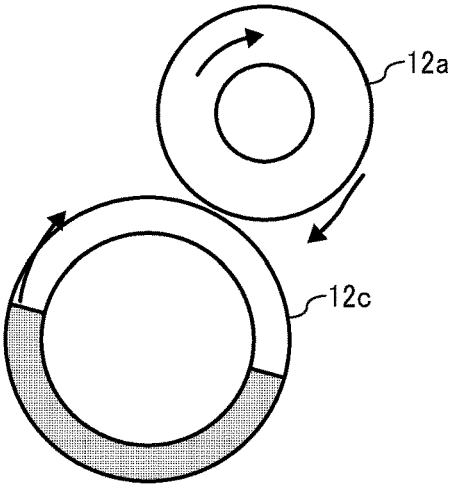

The diameter of the conveying screw may be increased to increase the blade height h. Increasing the diameter of the conveying screw can suppress the decrease in the speed at which the surface of the shaft and the portions of the screw blade adjacent to the shaft rotate, thereby suppressing the decrease in the shearing force acting on the developer. In this case, however, the conveying screw is large relative to the developing roller 12*a*. In an arrangement illustrated in FIG. 12A, the second conveying screw 12*c* has a large diameter and is disposed to desirably scoop the developer onto the developing roller 12*a*. That is, the scooping side of the second conveying screw 12*c* is close to the developing roller 12*a*. In this arrangement, the post-development developer, which is to be collected in the second developer compartment V2, may fall to the scooping side of the second conveying screw 12*c* and be again scooped onto the developing roller 12*a*. By contrast, in an arrangement illustrated in FIG. 12B, in which the second conveying screw 12*c* having a large diameter is disposed so that the post-development developer falls to the side opposite the scooping side of the second conveying screw 12*c*, the scooping side of the second conveying screw 12*c* is away from the developing roller 12*a*. In this case, the capability to scoop the developer onto the developing roller 12*a* is degraded. Therefore, increasing the diameter of the conveying screw is not preferred.

By contrast, a low blade height h can alleviate the inconvenience that the developer adjacent to the shaft is inhibited from moving. When the diameter of the shaft is increased to lower the blade height h, the speed at which the surface of the shaft rotates and the speed at which the portions of the screw blade adjacent to the shaft rotate can increase. Consequently, the shearing force acting on the developer can increase. Thus, when the blade height h is low, the developer lock can be inhibited even when the screw-blade pitch P is reduced to some extent.

In the experiment, in which the ratio (P/h) of the screw-blade pitch P relative to the blade height h of the second conveying screw 12*c* was changed to evaluate the capability of the second conveying screw 12*c*, a desirable result was attained when the ratio P/h is in the range of from 3.33 to 5.67 (3.33≤P/h≤5.67).

Next, the experiment to verify the effects of the present embodiment is described below.

The experiment was conducted using conveying screws Nos. 1 through 24 (presented in Table 1) different in the blade height h, the screw-blade pitch P, the lead angle α, and the like. The developing roller used in the experiment has a diameter of 18 mm.

The conveying screws Nos. 1 through 24 were installed in the developing device 12, described above with reference to FIGS. 3 through 11B. An A3-size solid image was printed consecutively on 30 sheets, a solid patch image was printed on a sheet, and then density variations in the patch were measured as in-page density variation. Using an X-Rite densitometer, the image density was measured at six positions of the patch, namely, the upper left, the upper center, the upper right, the lower left, the lower center, and the lower right. The in-page density variation (%) is calculated as $$\{D_{max}-D_{min}/\text{6-point mean density}\}\times 100$$

where $D_{max}$-represents a highest density, and $D_{min}$ represents a lowest density.

The result was evaluated as "Good" when the in-page density variation was equal to or lower than 20%, and result was evaluated as "Poor" when the density variation exceeded 20%. Table 1 presents the results of the evaluation.

TABLE 1

| No. | Threads Number | Lead L [mm] | Lead angle α [°] | Screw diameter D [mm] | Shaft diameter d [mm] | Blade height h [mm] | Pitch P [mm] | P/h | Evaluation |
|---|---|---|---|---|---|---|---|---|---|
| 1 | 6 | 48 | 41.9 | 17 | 11 | 3.00 | 8.0 | 2.67 | Poor |
| 2 | 3 | 30 | 29.3 | 17 | 11 | 3.00 | 10.0 | 3.33 | Poor |
| 3 | 4 | 40 | 36.8 | 17 | 11 | 3.00 | 10.0 | 3.33 | Good |
| 4 | 5 | 50 | 43.1 | 17 | 11 | 3.00 | 10.0 | 3.33 | Good |
| 5 | 6 | 60 | 48.3 | 17 | 11 | 3.00 | 10.0 | 3.33 | Poor |
| 6 | 4 | 44 | 39.5 | 17 | 11 | 3.00 | 11.0 | 3.67 | Good |
| 7 | 4 | 48 | 41.9 | 17 | 11 | 3.00 | 12.0 | 4.00 | Good |
| 8 | 3 | 38 | 35.1 | 17 | 11 | 3.00 | 12.5 | 4.17 | Good |
| 9 | 4 | 50 | 43.1 | 17 | 11 | 3.00 | 12.5 | 4.17 | Good |
| 10 | 3 | 40 | 36.8 | 17 | 11 | 3.00 | 13.3 | 4.44 | Good |
| 11 | 4 | 53 | 45.0 | 17 | 11 | 3.00 | 13.3 | 4.44 | Good |
| 12 | 3 | 42 | 38.2 | 17 | 11 | 3.00 | 14.0 | 4.67 | Good |
| 13 | 2 | 30 | 29.3 | 17 | 11 | 3.00 | 15.0 | 5.00 | Poor |
| 14 | 3 | 45 | 40.1 | 17 | 11 | 3.00 | 15.0 | 5.00 | Good |
| 15 | 3 | 48 | 41.9 | 17 | 11 | 3.00 | 16.0 | 5.33 | Good |
| 16 | 2 | 34 | 32.5 | 17 | 11 | 3.00 | 17.0 | 5.67 | Poor |
| 17 | 3 | 51 | 43.7 | 17 | 11 | 3.00 | 17.0 | 5.67 | Good |
| 18 | 4 | 68 | 51.9 | 17 | 11 | 3.00 | 17.0 | 5.67 | Poor |
| 19 | 5 | 85 | 57.9 | 17 | 11 | 3.00 | 17.0 | 5.67 | Poor |
| 20 | 2 | 50 | 43.1 | 17 | 11 | 3.00 | 25.0 | 8.33 | Poor |
| 21 | 3 | 42 | 43.7 | 14 | 6 | 4.00 | 14.0 | 3.50 | Good |
| 22 | 3 | 66 | 43.7 | 22 | 11 | 5.50 | 22.0 | 4.00 | Good |
| 23 | 3 | 51 | 43.7 | 17 | 7 | 5.00 | 17.0 | 3.40 | Good |
| 24 | 5 | 25 | 25.1 | 17 | 7 | 5.00 | 5.0 | 1.00 | Poor |

In the conveying screws Nos. 1 and 24, since the screw-blade pitch P is small relative to the blade height h, the space for the developer to move freely is small. Accordingly, when the developing device 12 was operated under hot and humid conditions, clearances between the winding threads were clogged with the developer. Thus, in the case of the conveying screws Nos. 1 and 24, the developer lock may occur over time.

In the conveying screws Nos. 2, 13, and 16, since the lead angle α was too small, the speed of developer conveyance was too slow, and the in-page density variation exceeded 20%. In the case of the conveying screws Nos. 5, 18, and 19, the in-page density variation exceeded 20%. The lead angle α of each of the conveying screws Nos. 5, 18, and 19 is large. The conveying screws Nos. 5, 18, and 19 presumably flipped a greater amount of developer, and the amount of developer moving in the axial direction decreased, resulting in the in-page density variation exceeding 20%.

In the case of the conveying screw No. 20, the in-page density variation exceeded 20%. In the solid image patch, slant lines of image density unevenness corresponding to the screw-blade pitch P were observed. The screw-blade pitch P of the conveying screw No. 20 is too wide. The level of developer presumably became uneven between the portion where the spiral blade 12*c*2 was present and the rest, and the uneven image density corresponding to the screw-blade pitch P occurred. Additionally, it is conceivable that the in-page density variation exceeding 20% was caused since the amount of developer moving in the axial direction per unit time was small.

By contrast, as can be known from the evaluation of the conveying screws Nos. 3, 4, 6 through 12, 14, 15, 17, and 21 through 23, the in-page density variation can be restricted to 20% when the lead angle α is in the range of from 35.1° to 45° and $3.33 \leq P/h \leq 5.67$ is satisfied.

The various aspects of the present disclosure can attain, for example, the following effects, respectively.

Aspect 1

Aspect 1 concerns a developing device (12) including a developer bearer (e.g., the developing roller 12*a*) to bear developer on a surface thereof and a conveying screw (e.g., the second conveying screw 12*c*) disposed lower than the developer bearer and in a developer containing compartment (e.g., the second developer compartment V2). The developing device further includes an inclined face K extending from an inner wall (e.g., the upper casing 1211) of the developer containing compartment obliquely upward toward the developer bearer and opposing the conveying screw from above. That is, an end of the inclined face K on a side of the developer bearer is positioned higher than the other end of the inclined face K adjacent to the inner wall of the developer containing compartment.

As the amount of developer in the developer containing compartment is reduced, the image density of the developed image becomes uneven corresponding to the screw-blade pitch of the conveying screw from the reason described below. As the amount of developer in the developer containing compartment is reduced, the surface of the developer recedes from the surface of the developer bearer. Then, the surface of the developer is outside the range in which the developer scooping pole exerts the magnetic force to scoop the developer. That is, the magnetic force of the developer scooping pole is less likely to directly scoop the developer from the developer containing compartment onto the developer bearer. Consequently, what scooped by the magnetic force of the developer scooping pole is the developer that has been lifted by the screw blade of the conveying screw to a position adjacent to the developer bearer. Then, a sufficient amount of developer is borne on a portion around the position where the developer bearer opposes the spiral blade of the conveying screw. In a portion not opposing the screw blade, however, the developer is rarely borne on the developer bearer. Accordingly, in the portion not opposing the screw blade, the layer thickness of the developer is thinner (narrower) than the regulation gap. While the developer passes the regulation gap between the developer regulator and the developer bearer, the developer blocked by the developer regulator moves in the longitudinal direction (the axial direction) of the developer bearer to the portion bearing a smaller amount of developer. However, the amount of developer may not be increased to the prescribed amount. As a result, the unevenly borne developer is carried to the developing range, causing the uneven image density corresponding to the screw-blade pitch of the conveying screw.

Studying the behavior of developer lifted by the screw blade of the conveying screw, the inventors have found the following. Due to the momentum of the screw blade, a portion of the developer lifted by the screw blade is flipped from the screw blade upward. The developer flipped up is not captured by the magnetic force of the magnetic field generator but falls under the gravity to the developer containing compartment. While falling to the developer containing compartment, the falling developer collides with the developer being lifted by the screw blade toward the surface of the developer bearer, thereby reducing the amount of developer lifted to the position adjacent to the surface of the developer bearer. Thus, the falling developer reduces the amount of developer scooped by the magnetic force of the developer scooping pole.

In view of the foregoing, according to Aspect 1, the developing device includes the inclined face inclined to oppose the conveying screw from above. The inclined face is inclined such that the side of the inclined face adjacent to the developer bearer is higher than the opposite side. With this configuration, the developer flipped up from the conveying screw contacts the inclined face and is deflected toward the developer bearer. Then, the magnetic force of the magnetic field generator attracts the deflected developer to be borne on the developer bearer. Thus, the developer bearer can carry the developer flipped upward from the conveying screw, in addition to the developer that has been lifted to the position adjacent to the developer bearer by the screw blade and scooped onto the developer bearer by the magnetic force of the developer scooping pole. Thus, the inclined face can increase the amount of developer borne on the developer bearer.

Further, the inclined face can inhibit the flipped developer from falling under the gravity to the developer containing compartment. Thus, the falling developer can be inhibited from colliding with the developer being lifted by the screw blade to the position adjacent to the developer bearer. Then, the screw blade can bring up a greater amount of developer close to the developer bearer, thereby increasing the amount of developer scooped by the developer scooping pole onto the developer bearer.

Since Aspect 1 can increase the amount of developer scooped onto the developer bearer, the aspect A can reduce the difference between the layer thickness of developer and the regulation gap in the portion (where the amount of developer is smaller) that does not oppose the screw blade at the position where the developer lifted by the screw blade is scooped onto the developer bearer. Additionally, the amount of developer increases in the portion opposing the screw blade at the position where the developer lifted by the screw blade is scooped onto the developer bearer, and the amount of developer blocked by the developer regulator can increase. Thus, after the developer is blocked by the developer regulator, a greater amount of developer can flow in the axial direction to the portion that does not oppose the screw blade, where the amount of developer is smaller. Thus, downstream from the regulation gap, the amount of developer is equalized, and, in developed images, uneven image density corresponding to the screw-blade pitch of the conveying screw is suppressed.

Aspect 2

The developing device according to Aspect 1 further includes a developer regulator disposed opposite the developer bearer across a regulation gap to adjust an amount of the developer borne on a surface of the developer bearer, and the inclined face K extends to a portion adjacent to an end of the developer regulator defining the regulation gap.

According to this aspect, the inclined face can inhibit the developer blocked by the developer regulator (e.g., the developer doctor 12*d*) from moving away from the developer bearer (e.g., the developing roller 12*a*). Then, the developer blocked by the developer regulator can be kept in the range of magnetic force of the magnetic field generator (e.g., the magnet roller 12*a*1) disposed inside developer bearer. Thus, the blocked developer can be inhibited from falling to the developer containing compartment such as the second developer compartment V2. Accordingly, the developer can be dense upstream from the developer regulator in the rotation direction of the developer bearer. Then, even when the amount of developer scooped by the developer scooping pole P4 is uneven corresponding to the screw-blade pitch of the conveying screw (e.g., the second conveying screw 12*c*), the developer is leveled while the surface of the developer bearer pass the dense developer portion. Thus, downstream from the regulation gap, the amount of developer is equalized, and, in developed images, uneven image density corresponding to the screw-blade pitch of the conveying screw (e.g., the second conveying screw 12*c*) is suppressed.

Aspect 3

In Aspect 3, an end of the inclined face, such as the guide 12*g*, is in contact with the developer regulator, such as the developer doctor 12*d*.

This configuration can inhibit the developer from passing a gap between the inclined face (e.g., the guide 12*g*) and the developer regulator (e.g., the developer doctor 12*d*) and entering the space S1 enclosed by the inclined face, the developer regulator, and the developing device casing.

Aspect 4

In Aspect 2 or 3, the inclined face K is disposed to progressively reduce a clearance between the inclined face K and the developer bearer (e.g., the developing roller 12*a*) in a direction toward the developer regulator (e.g., the developer doctor 12*d*).

According to this aspect, the developer gathers as the position approaches the regulation gap (e.g., the doctor gap DG), and the developer can be dense upstream from the developer regulator in the rotation direction of the developer bearer.

Aspect 5

In any one of Aspects 1 through 4, the developer bearer (e.g., the developing roller 12*a*) includes a magnetic field generator such as the magnet roller 12*a*1, and the magnetic field generator has a developer scooping pole to scoop the developer in the developer containing compartment onto the surface of the developer bearer. Further, the inclined face extends into an area of magnetic-flux density of the developer scooping pole in a direction normal to the surface of the developer bearer.

According to this aspect, the inclined face (e.g., the guide 12*g*) can guide the developer flipped from the conveying screw (e.g., the second conveying screw 12*c*) to the area of magnetic-flux density of the developer scooping pole in the normal direction normal. Then, the magnetic force of the developer scooping pole can attracts the flipped developer to be borne on the developer bearer.

Aspect 6

The developing device according to any one of Aspects 1 through 5 further includes a developer regulator disposed opposite the developer bearer across a regulation gap to adjust an amount of the developer borne on a surface of the developer bearer, and the developer regulator is rod-shaped.

As described above, a solid rod cut from a base material can be used as the rod-shaped developer regulator, subjected only to end-face treatment. Thus, the production cost of the device can be low.

Additionally, when the developer regulator is rod-shaped, the space upstream from the developer regulator in the rotation direction of the developer bearer can be progressively narrowed in the direction toward the regulation gap between the developer regulator and the developer bearer. With this configuration, as the developer borne on the surface of the developer bearer approaches the regulation gap, the developer becomes dense gradually. The developer can pass the regulation gap in a dense state. As a result, compared with the configuration illustrated in FIG. 9, in which the space is abruptly narrowed upstream from the regulation gap, the developer is inhibited from remaining adjacent to the developer regulator. Then, adhesion of develop to the developer regulator is inhibited.

Additionally, in the configuration in which the end of the inclined face (e.g., the guide 12*g*) is disposed abutting against the rod-shaped developer regulator, even when the position where the inclined face abuts against the developer regulator varies, the face opposing the developer bearer is inclined mildly toward the regulation gap, compared with a case where the developer regulator is a blade. Thus, the rod-shaped developer regulator can inhibit the developer from remaining adjacent to the developer regulator and inhibit adhesion of developer to the developer regulator.

Aspect 7

In any one of Aspects 1 through 6, the end of the inclined face (e.g., the guide 12*g*) adjacent to the inner wall of the developer containing compartment is lower than a top position on an outer diameter circumference of the conveying screw (e.g., the second conveying screw 12*c*).

Such relative positions can reduce the distance for the developer flipped up from the conveying screw to travel to the range of the magnetic force of the magnetic field generator, compared with a configuration in which the second end of the inclined face is higher than the top position on the outer diameter circumference of the conveying screw. Then, the momentum can be kept until the developer flipped up by the conveying screw reaches the range of the magnetic force of the magnetic field generator, thereby inhibiting the developer from falling to the developer containing compartment. Then, the flipped developer can be borne on the developer bearer.

Aspect 8

In any one of Aspects 1 through 7, a lead angle of the conveying screw is in a range of from 35.1° to 45°, and the screw-blade pitch (P) of the conveying screw is a range of from 3.33 times to 5.67 times greater than the blade height (h) of the conveying screw). That is, the screw-blade pitch P and the blade height h satisfy $3.33 \leq P/h \leq 5.67$.

According to this aspect, developer circulation efficiency is enhanced, and uneven toner concentration is suppressed.

Aspect 9

In any one of Aspects 1 through 8, the conveying screw (e.g., the second conveying screw 12*c*) satisfies $$D/L \leq 0.5,$$

where L represents a lead of the conveying screw, and D represents an outer diameter of the conveying screw.

According to this aspect, as described above, the screw blade of the conveying screw lies low, and the conveying screw can lift the developer from the developer containing compartment onto the surface of the developer bearer (e.g., the developing roller 12*a*). Accordingly, even when the level of developer descends in the developer containing compartment, the developer can be desirably scooped onto the surface of the developer bearer. Further, Although the screw blade lying low increases the amount of developer flipped vertically up, the guide 12*g* can guide the flipped developer to be borne on the developer bearer. Therefore, even when the amount of developer in the developer containing compartment is smaller, a sufficient amount of developer can be borne on the developer bearer.

Aspect 10

In an image forming apparatus, such as the image forming apparatus 500, that includes a latent image bearer (e.g., the photoconductor 10) and a developing device to develop the latent image on the latent image bearer, the developing device according to any one of aspects 1 through 9 is used.

Accordingly, the above-described uneven image density corresponding to the screw-blade pitch of the conveying screw (e.g., the second conveying screw 12*c*) is inhibited, and desirable images can be produced.

Aspect 11

In a process cartridge including, at least, the latent image bearer (e.g., the photoconductor 10) and the developing device united together and is configured to be removably mounted in an image forming apparatus, the developing device according to any one of Aspects 1 through 9 is used.

Accordingly, with the process cartridge, the above-described uneven image density corresponding to the screw-blade pitch of the conveying screw (e.g., the second conveying screw 12*c*) is inhibited, and desirable images can be produced.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A developing device comprising:

a developer bearer to bear developer;

a developer containing compartment disposed lower than the developer bearer;

a conveying screw disposed in the developer containing compartment;

an inclined face extending from an inner wall of the developer containing compartment obliquely upward toward the developer bearer, the inclined face opposing the conveying screw from above; and a developer regulator disposed opposite the developer bearer across a regulation gap to adjust an amount of the developer borne on a surface of the developer bearer, wherein the inclined face extends proximate to an end of the developer regulator defining the regulation gap.

2. The developing device according to claim 1, wherein an end of the inclined face is in contact with the developer regulator.

3. The developing device according to claim 1, wherein the inclined face is disposed to progressively reduce a clearance between the inclined face and the developer bearer in a direction toward the developer regulator.

4. The developing device according to claim 1, wherein the developer bearer includes a magnetic field generator having a developer scooping pole to scoop the developer in the developer containing compartment onto a surface of the developer bearer, and wherein the inclined face extends into an area of magnetic-flux density of the developer scooping pole in a direction normal to the surface of the developer bearer.

5. The developing device according to claim 1, further comprising a developer regulator disposed opposite the developer bearer across a regulation gap to adjust an amount of the developer borne on a surface of the developer bearer, wherein the developer regulator is rod-shaped.

6. The developing device according to claim 1, wherein an end of the inclined face adjacent to the inner wall of the developer containing compartment is lower than a top position on an outer diameter circumference of the conveying screw.

7. The developing device according to claim 1, wherein a lead angle of the conveying screw is in a range of from 35.1° to 45°, and wherein a screw-blade pitch of the conveying screw and a blade height satisfy a relation represented as $3.33 \leq P/h \leq 5.67$, where P represents the screw-blade pitch, and h represent the blade height.

8. The developing device according to claim 1, wherein the conveying screw satisfies a relation represented as $DI \leq 0.5$, where L represents a lead of the conveying screw, and D represents an outer diameter the conveying screw.

9. An image forming apparatus comprising:

a latent image bearer to bear a latent image; and the developing device according to claim 1 to develop the latent image on the latent image bearer with the developer.

10. A process cartridge to be removably mounted in an image forming apparatus, the process cartridge comprising:

a latent image bearer to bear a latent image;

the developing device according to claim 1 to develop the latent image; and a frame to support the latent image bearer and the developing device as a unit.

11. A developing device comprising:

a developer bearer to bear developer;

a developer containing compartment disposed lower than the developer bearer;

a conveying screw disposed in the developer containing compartment; and an inclined face extending from an inner wall of the developer containing compartment obliquely upward toward the developer bearer, the inclined face opposing the conveying screw from above, wherein a lead angle of the conveying screw is in a range of from 35.1° to 45°, and wherein a screw-blade pitch of the conveying screw and a blade height satisfy a relation represented as $3.33 \leq P/h \leq 5.67$, where P represents the screw-blade pitch, and h represent the blade height.

12. The developing device according to claim 11, wherein the inclined face is disposed to progressively reduce a clearance between the inclined face and the developer bearer in a direction toward the developer regulator.

13. The developing device according to claim 11, wherein the developer bearer includes a magnetic field generator having a developer scooping pole to scoop the developer in the developer containing compartment onto a surface of the developer bearer, and wherein the inclined face extends into an area of magnetic-flux density of the developer scooping pole in a direction normal to the surface of the developer bearer.

14. The developing device according to claim 11, further comprising a developer regulator disposed opposite the developer bearer across a regulation gap to adjust an amount of the developer borne on a surface of the developer bearer, wherein the developer regulator is rod-shaped.

15. A developing device comprising:

a developer bearer to bear developer;

a developer containing compartment disposed lower than the developer bearer;

a conveying screw disposed in the developer containing compartment; and an inclined face extending from an inner wall of the developer containing compartment obliquely upward toward the developer bearer, the inclined face opposing the conveying screw from above, wherein the conveying screw satisfies a relation represented as $D/L \leq 0.5$, where L represents a lead of the conveying screw, and D represents an outer diameter the conveying screw, wherein the conveying screw is configured to rotate such that a spiral blade of the conveying screw ascends from a lowest position in rotation towards the inclined face to allow developer to ascend from the conveying screw along the inclined face.

16. The developing device according to claim 15, wherein the inclined face is disposed to progressively reduce a clearance between the inclined face and the developer bearer in a direction toward the developer regulator.

17. The developing device according to claim 15, wherein the developer bearer includes a magnetic field generator having a developer scooping pole to scoop the developer in the developer containing compartment onto a surface of the developer bearer, and wherein the inclined face extends into an area of magnetic-flux density of the developer scooping pole in a direction normal to the surface of the developer bearer.

18. The developing device according to claim 15, further comprising a developer regulator disposed opposite the developer bearer across a regulation gap to adjust an amount of the developer borne on a surface of the developer bearer, wherein the developer regulator is rod-shaped.

* * * * *